US007430841B2

(12) United States Patent
Seiffert

(10) Patent No.: US 7,430,841 B2
(45) Date of Patent: Oct. 7, 2008

(54) APPARATUS FOR LOADING SMALL OBJECTS INTO BLISTERS OF PACKAGING FOIL

(75) Inventor: Martin Seiffert, Schelklingen (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 0 days.

(21) Appl. No.: 11/897,356

(22) Filed: Aug. 30, 2007

(65) Prior Publication Data

US 2008/0056862 A1 Mar. 6, 2008

(30) Foreign Application Priority Data

Sep. 2, 2006 (DE) ..... 10 2006 041 199

(51) Int. Cl.
*B65B 5/08* (2006.01)

(52) U.S. Cl. ..... 53/247

(58) Field of Classification Search ..... 53/244, 53/245, 246, 247; 414/732, 736
See application file for complete search history.

(56) References Cited

U.S. PATENT DOCUMENTS

| | | | | | |
|---|---|---|---|---|---|
| 3,168,204 | A * | 2/1965 | Voullaire | 53/247 |
| 3,300,945 | A * | 1/1967 | Grossi et al. | 53/247 |
| 3,368,324 | A * | 2/1968 | Leedy | 53/247 |
| 3,774,778 | A * | 11/1973 | Flaig | 53/247 |
| 3,780,492 | A * | 12/1973 | Corderoy | 53/247 |
| 4,778,329 | A * | 10/1988 | Phillips | 414/732 |
| 4,820,113 | A * | 4/1989 | Farquhar | 414/736 |
| 4,915,368 | A * | 4/1990 | Tsunekawa et al. | 53/246 |
| 4,918,907 | A * | 4/1990 | Roach et al. | 53/246 |
| 5,117,611 | A * | 6/1992 | Heck et al. | 53/247 |
| 5,133,169 | A * | 7/1992 | Tesch et al. | 53/247 |
| 5,279,099 | A * | 1/1994 | Goodman et al. | 53/247 |
| 5,471,738 | A * | 12/1995 | Burcham et al. | 414/736 |
| 5,611,193 | A * | 3/1997 | Farrelly | 53/245 |
| 5,655,355 | A * | 8/1997 | Ramler | 53/244 |
| 5,666,786 | A * | 9/1997 | Focke et al. | 53/247 |
| 5,743,068 | A * | 4/1998 | Madariaga | 53/247 |
| 5,934,859 | A | 8/1999 | Goetzelmann | |
| 6,925,774 | B2 * | 8/2005 | Peterson | 53/247 |

FOREIGN PATENT DOCUMENTS

| | | |
|---|---|---|
| DE | 102005007532 | 2/2006 |
| EP | 1 072 516 | 1/2001 |
| EP | 1 342 666 | 9/2003 |
| GB | 2 172 257 | 9/1986 |

* cited by examiner

*Primary Examiner*—Louis K Huynh
(74) *Attorney, Agent, or Firm*—Andrew Wilford

(57) ABSTRACT

An apparatus for transferring a plurality of objects from a pickup station to blisters of an adjacent passing foil has a stationary support adjacent the foil and pickup station and defining a support axis and an arm pivotal on the support about the support axis and extending radially from the support axis. A slide shiftable on the arm radially of the support axis defines a slide axis about which a suction grab can pivot. The suction grab is adapted to pick up and drop a plurality of the objects. First and second drives have motors on the support and serve for pivoting the arm about the support axis between a pickup position with the grab over the pickup station and a deposit position with the grab over the passing foil and for shifting the slide along the arm.

11 Claims, 10 Drawing Sheets

APPARATUS FOR LOADING SMALL OBJECTS INTO BLISTERS OF PACKAGING FOIL

FIELD OF THE INVENTION

The present invention relates to filling small objects into blisters of a packaging foil. More particularly this invention concerns an apparatus that transfers batches of the objects to a continuously passing foil.

BACKGROUND OF THE INVENTION

In the production of a packages of objects such as tablets, capsules, pills, or the like the objects are typically delivered to the packaging machine in bulk form. First they are separated and arrayed in a holder in rows and columns, normally with a single object in a respective pocket formed in a plate in a pickup station. From here a group or batch of the objects are picked up by a suction grab that transfers them to upwardly open blisters of a packaging-foil strip that is moved continuously past the pickup station. This transfer apparatus, which is the subject of the instant invention, must therefore work quickly, picking up and dropping large numbers of small objects with great accuracy. The product being packaged is often relatively valuable and any empty blisters will require an entire package to be culled out, so the machine must function without failure for a long production run. Downstream of the transfer device a cover foils is typically laminated atop the blister foil, and the two foils are cut up into packages and further prepared for distribution.

In most systems the grab is a large suction grab plate with an array of downwardly open suckers. This plate is swung in an arc between a position above the pickup station where each sucker is aligned above with a respective object-holding pocket and a position over the passing strip where each sucker is aligned above a respective blister. When above the strip the grab must move in a straight line parallel to the travel direction of the strip at least during the time when the suction is cut and the objects are dropped into the blisters. Thus the grab plate moves through an arcuate path from the pickup station to above the strip, then in a straight line with the strip, although it can move wholly arcuately on the way back to the pickup station. Such compound movement is very hard to do.

Such a generic apparatus is described in German patent 10 2005 007 532 of J. Matzenmuller. The disadvantage associated with this apparatus is that rotation of the transfer unit about the slide axis, which is not a function of the rotary displacement of the pivot arm about the support axis, and radial displacement of the transfer unit relative to the support axis are accomplished with several different drives mounted right on the movable parts. The structure is complex and fairly massive, so that it moves relatively slowly.

Other systems described in EP 1,072,516 of M. Spataforo, EP 1,342,666 of B. Tonnigs, GB 2,172,257 of W. Hogenkamp, and U.S. Pat. No. 5,934,859 of B. Goetzelmann are similarly complex, massive, and slow.

OBJECTS OF THE INVENTION

It is therefore an object of the present invention to provide an improved apparatus for loading small objects into blisters of packaging foil.

Another object is the provision of such an improved apparatus for loading small objects into blisters of packaging foil that overcomes the above-given disadvantages, in particular that is of simple and light construction so that it can move quickly, yet accurately.

SUMMARY OF THE INVENTION

An apparatus for transferring a plurality of objects from a pickup station to blisters of an adjacent passing foil has according to the invention a stationary support adjacent the foil and pickup station and defining a support axis and an arm pivotal on the support about the support axis and extending radially from the support axis. A slide shiftable on the arm radially of the support axis defines a slide axis about which a suction grab can pivot. The suction grab is adapted to pick up and drop a plurality of the objects. A first drive includes a first motor on the support and a linkage between the first motor and the arm for pivoting the arm about the support axis between a pickup position with the grab over the pickup station and a deposit position with the grab over the passing foil. A second drive includes a motor on the support and a linkage between the first motor and the slide for shifting the slide along the arm. A third drive has a linkage connected between the support and the grab for pivoting the grab about the slide axis relative to the slide.

The advantage of this system is that radial movement of the transfer unit, independent of the rotation of the support axis, and rotational displacement about the slide axis are attained in a simple manner. The result of this is that it is fundamentally possible to have a plurality of retrieval positions at which the objects are picked up by the transfer unit and a plurality of deposition position at which the objects are deposited into the blisters of a foil strip.

Here, it is particularly preferred when the second drive is a knee-lever linkage for displacement of the transfer unit radial to the support axis. It is formed of two pivoted-together knee levers with an inner end of an inner lever being pivoted at the support axis and an outer end of an outer lever pivoted at the slide axis. This provides precise and reliable positioning of the transfer unit in a structurally simple manner. In addition, when the length of the individual knee lever is selected properly, the travel of the radial movement of the transfer unit can be determined in advance.

Moreover, it is preferred when the knee lever near the drive can be moved by means of a drive belt using the second drive. This drive belt is reeved around a wheel at an inner end of the inner knee lever near the drive. This embodiment has few moving parts and is quite simple in construction.

It is furthermore preferred that the third drive for rotation of the transfer unit is formed by two belts arranged in series that both wrap around a freely rotatable pulley that is arranged coaxial with a common axis of the knee lever, and such that the one belt is reeved around a pulley fixed rotationally coaxial with the support axis and the second belt is reeved around a pulley at the slide axis. In this way the rotational displacement of the transfer unit, for maintaining its orientation parallel with the foil strip, is obtained in the most structurally simple manner separate from the movement of the transfer unit radially of the support axis. Moreover, this embodiment makes it easy to maintain and requires only very little structural height and depth.

It is particular advantageous when the transfer unit is mounted on a slide that is arranged on the pivot arm and that is radially displaceable to the support axis. In this manner many different types of conventional and high quality, proven linear guide systems can be used that ensure extremely high precision and reliability, as well as a long service life.

Moreover, it possible for the pivot arm to be formed from two parallel guide rods between which the slide axis is arranged. This embodiment is distinguished in particular with respect to attainable mechanical stability and low material use and associated low weight, so that high angular accelerations can be attained when a pivot movement about the support axis is performed.

Alternatively, there is naturally also the option that the transfer unit is secured against displacement on the pivot arm and that the pivot arm can be displaced radial to the support axis in a mount pivotal at the support axis. In this embodiment the pivot radius and thus the structural size of the apparatus can be significantly reduced.

Moreover, it is particularly advantageous when the motors for first and second drive are fixed on the support.

Furthermore, it is particularly advantageous when a controller is connected to the first and/or to second drives. This enables precise definition of the movements of the transfer unit in terms of the parameters of acceleration, speed, delay, the chronological sequence of the individual parameters, and synchronization of the drives.

BRIEF DESCRIPTION OF THE DRAWING

The above and other objects, features, and advantages will become more readily apparent from the following description, reference being made to the accompanying drawing in which.

SPECIFIC DESCRIPTION

Figure 4:
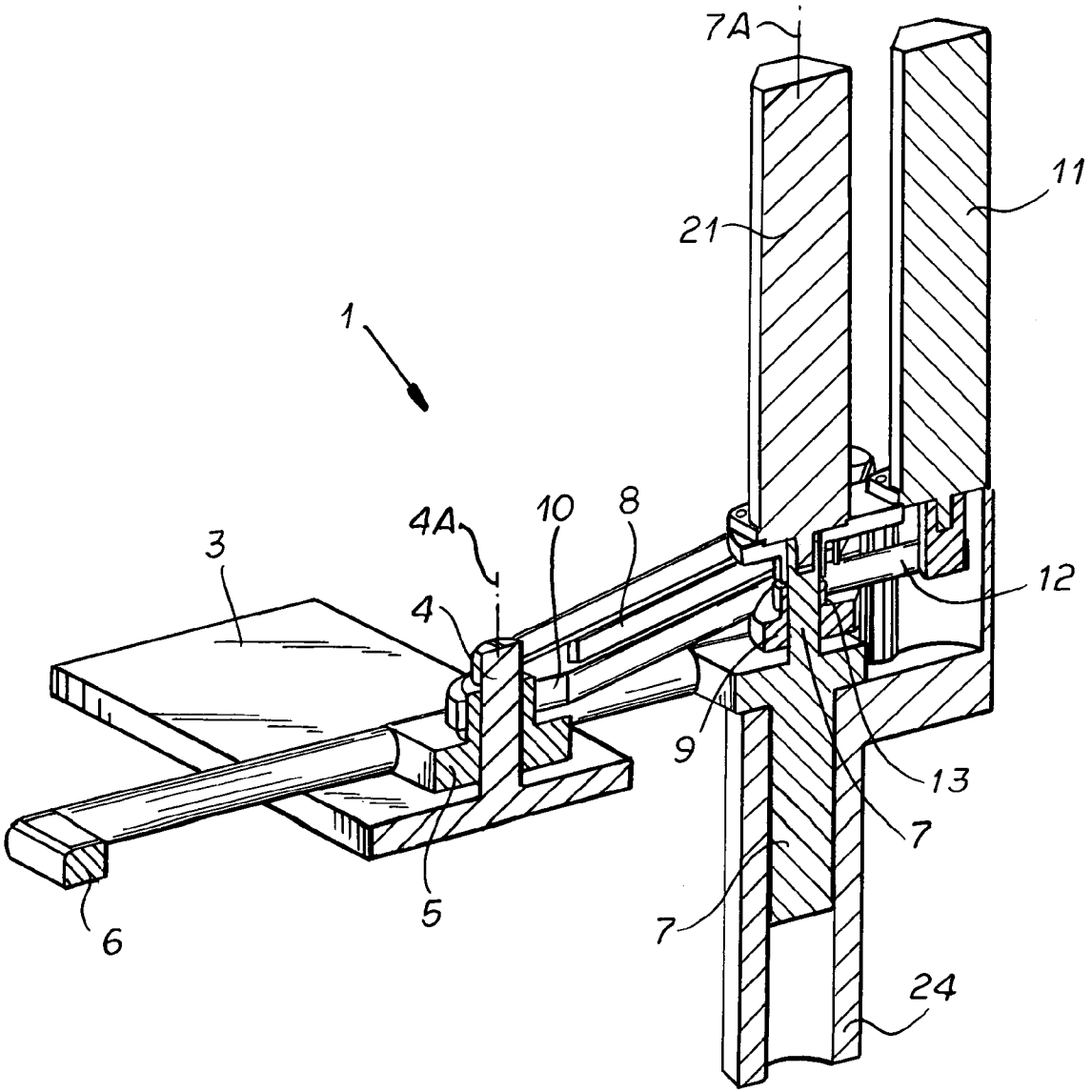
FIG. 4 is a perspective view partly in vertical section of the apparatus in FIG. 1.
Figure 5:
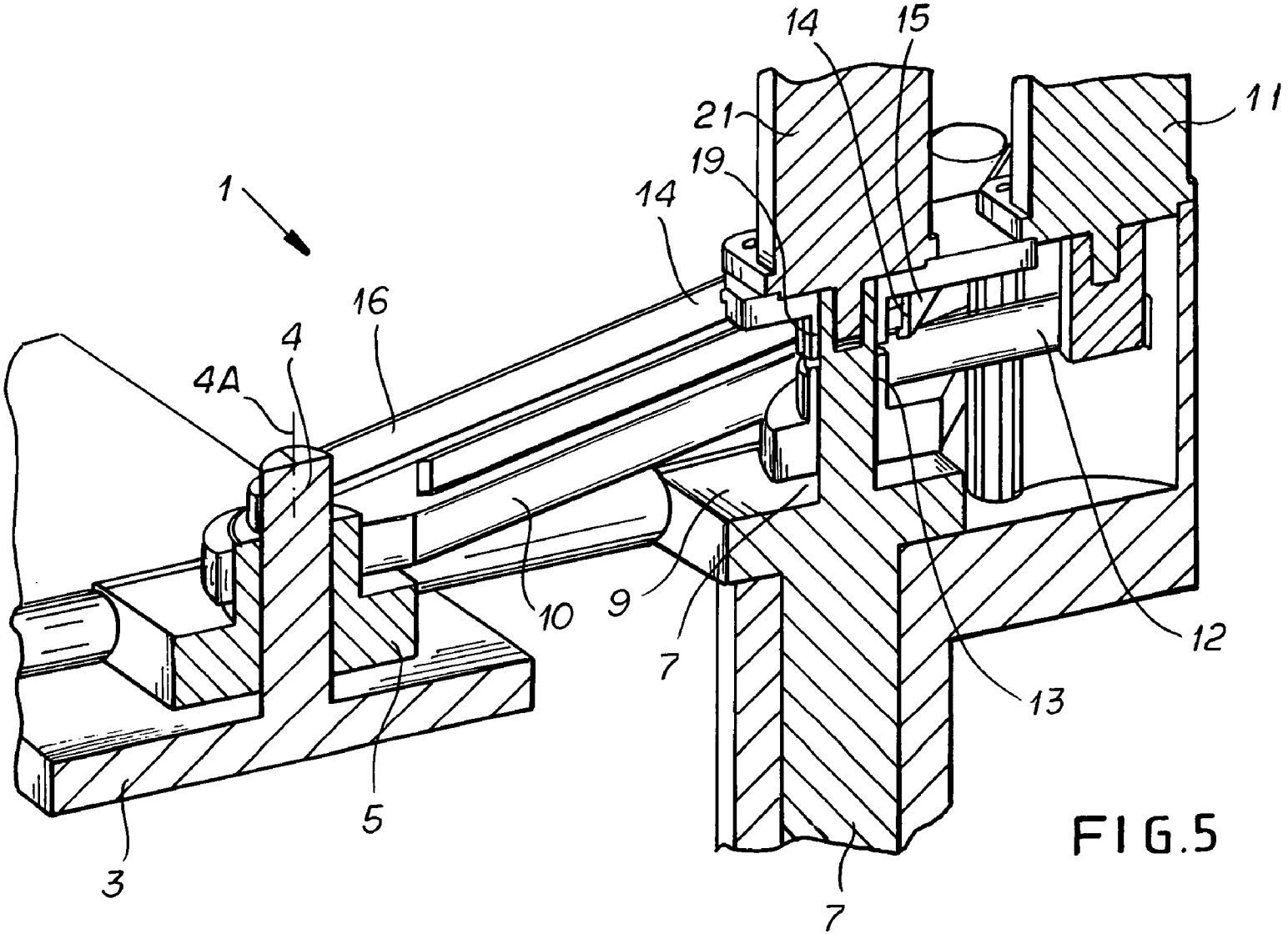
FIG. 5 is a large-scale view of a detail of the structure shown in FIG. 4.

As seen in FIGS. 1-8 an apparatus 1 is used for transferring objects O (FIG. 7), such as tablets, capsules, pills, and the like, sorted into a uniform column/row array into the similarly arrayed blisters of a foil strip 2 that is moved continuously by a drive 23 in a horizontal transport direction D. Here the objects O are picked up by means of a transfer unit, in this case a grab constituted by a suction plate 3. The suction plate 3 can rotate about an axis 4A defined by a shaft 4 that is perpendicular to the horizontal plane of the foil strip 2 and that is journaled in a carriage or slide 5 that in turn is slidable along a horizontal arm 6 that can pivoted about another vertical axis 7A that is defined by a shaft 7 and parallel to the axis 4. This shaft 7 is journaled in a stationary support or mount 24 (FIG. 4).

The suction plate 3 is displaceable along the arm 6 by means of the slide 5 radially of the axis 7 by means of a knee-lever linkage 8. As can be seen in particular in FIGS. 1 through 3, this knee-lever linkage 8 is formed by two horizontal levers 9 and 10. The lever 9 has an inner end at the support axis 7A and an outer end pivoted at an axis 9A on the inner end of the lever 10 whose outer end is pivoted at the slide axis 4A on the shaft 4. The inner lever 9 can be pivoted about the support axis 7A by a drive motor 11 through a drive belt 12 that is reeved around a pulley 13 forming the inner end of the knee lever 9. Gearing could replace the belt 12. Thus the motor 11 can pivot the arm 9 and thus establish the position of the slide 8 on the arm 6.

Figure 1:
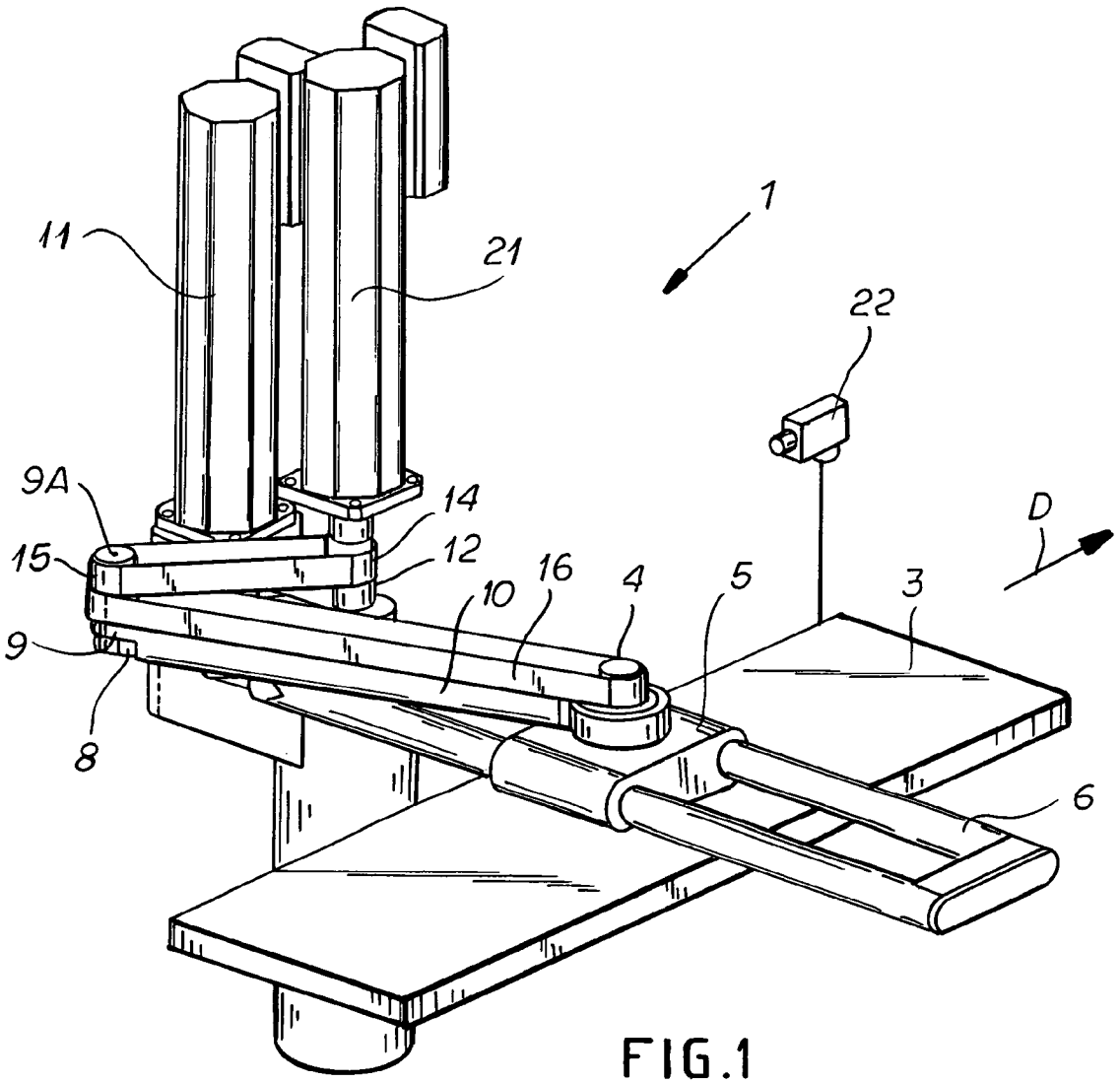
FIG. 1 is a perspective elevation of the inventive apparatus.
Figure 2:
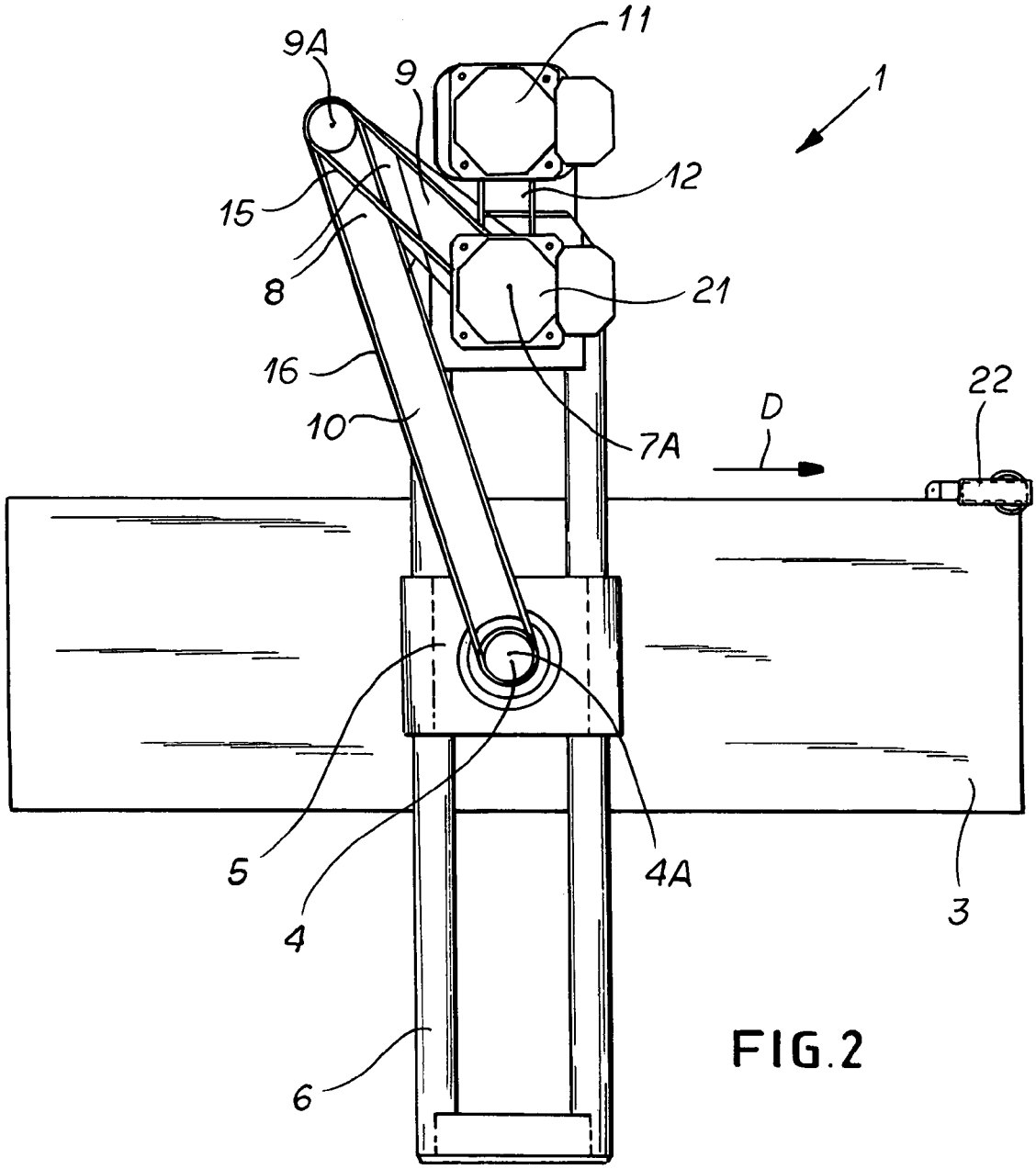
FIG. 2 is a top view of the apparatus of FIG. 1.
Figure 3:
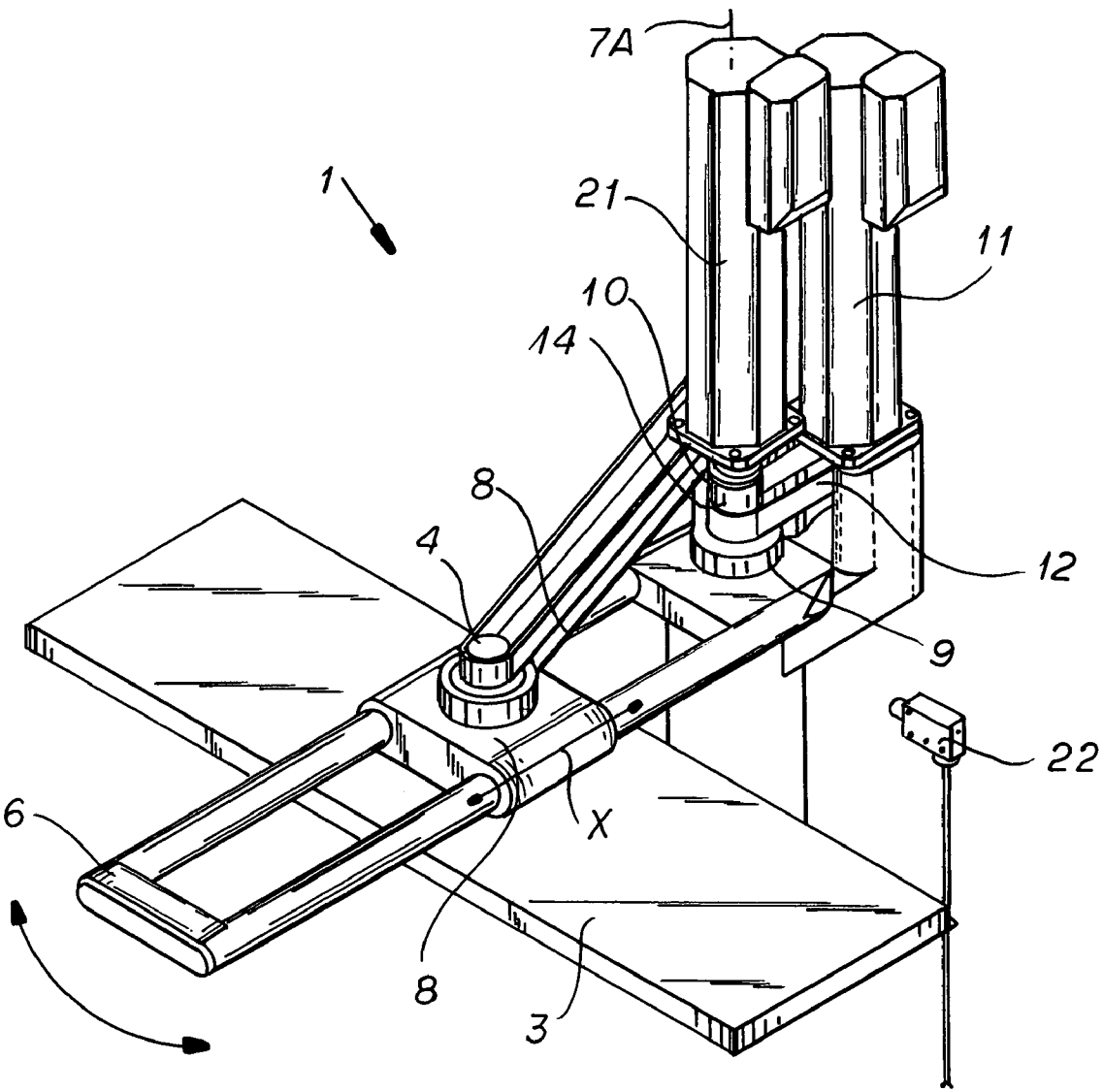
FIG. 3 is another perspective elevation of the apparatus of FIG. 1.
Figure 6:
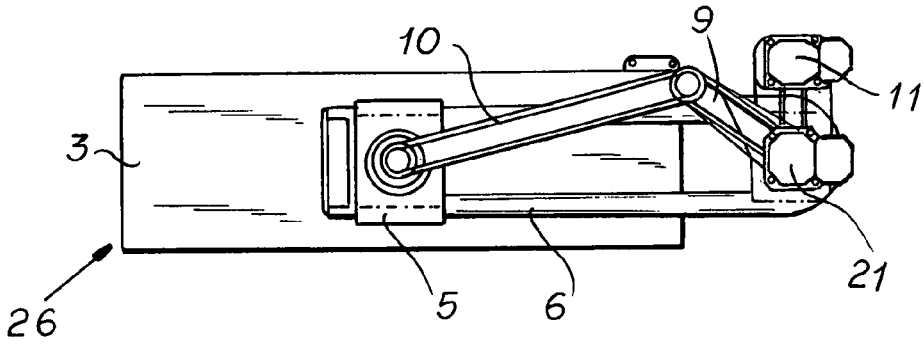
FIG. 6 is a top view of the apparatus in FIG. 1, picking up objects from a pickup station.
Figure 7:
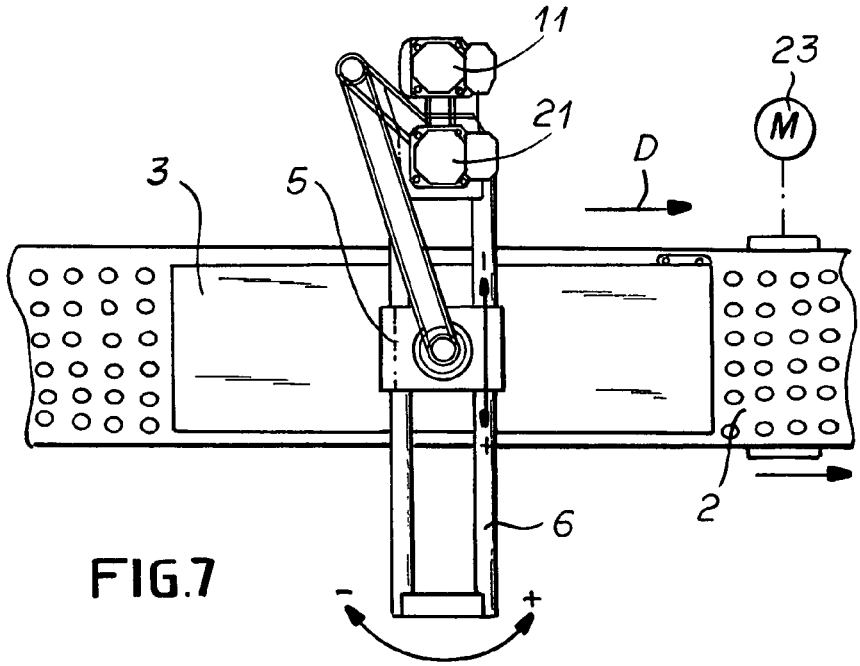
FIG. 7 is a view like FIG. 6 at during deposition of the objects.

As can be seen in particular in FIGS. 1 and 2, a flexible drive 14 is provided for angularly positioning the suction plate 3, here to maintain it at all times in the same angular position extending parallel to the direction D no matter where the slide axis 4A is located relative to the support axis 7A. In the embodiment depicted here the flexible drive 14 is formed by two toothed belts 15 and 16 that are both reeved over a pulley 17 that is rotatable at the axis 9A where the knee levers 9 and 10 are pivoted together. The inner end of the inner belt 15 is reeved around a pulley 19 fixed at the support axis 7A, while the outer end of the outer belt 16 is reeved around the shaft 4 on which the grab 3 is angularly fixed. Displacing the knee levers 9 and 10 necessarily causes, mediated by the belts 15, 16, a rotational displacement of the suction plate 3 about the slide axis 4. Here the effective diameter of the shaft 4 where it engages the belt 16 and the pulley 19 where it engages the belt 15 are the same, and both parts of the double pulley 17 engaging the belts 15 and 16 are of the same diameter, so that the shaft 4 remains in the same angular position as the shaft 7. Of course it would be possible to cause a pivoting of the grab 3 as it moves between its end positions at the pickup station as shown in FIG. 6 and over the film 3 as shown in FIG. 7, but the system shown here has the advantage of simplicity and making it possible to synchronize travel speeds of the grab 3 and film 3 more easily for dropping the objects 0 into the pockets of the film 3.

In accordance with a second illustrated embodiment that is shown in FIGS. 9 through 14, the transfer unit 3, secured against angular displacement, is arranged on the pivot arm 6 and the pivot arm 6 is displaceable radial to the support axis 7 in a pivot arm guide 20.

The drives 21 and 11 are fixed in the illustrated embodiments depicted here. In addition, a drive control 25 is connected to both drives 21 and 11.

Prior to using the apparatus, the system is calibrated using a template that precisely defines the path to be traveled by the suction plate 3 during a transfer cycle, as well as the orientation of the suction plate 3 with respect to the arrangement of the objects to be picked up in terms of the blisters of the foil strip. At the same time, different lever ratios must be compensated on the knee levers 9 and 10 by the belt tension of the flexible drive 14. The precise calibration occurs with the additional use of a light curtain 22 that detects the position of the suction plate 3 at a point on the path. Naturally a plurality of light curtains 22 can also be placed at relevant points on the path and the information derived therefrom can be used for determining the position of the suction plate at a given point in time, where necessary via a computer unit for the drive control of the first and second drives 21 and 11. It is also quite possible to use sensors that are the functional equivalents of a light barrier 22.

Figure 8:
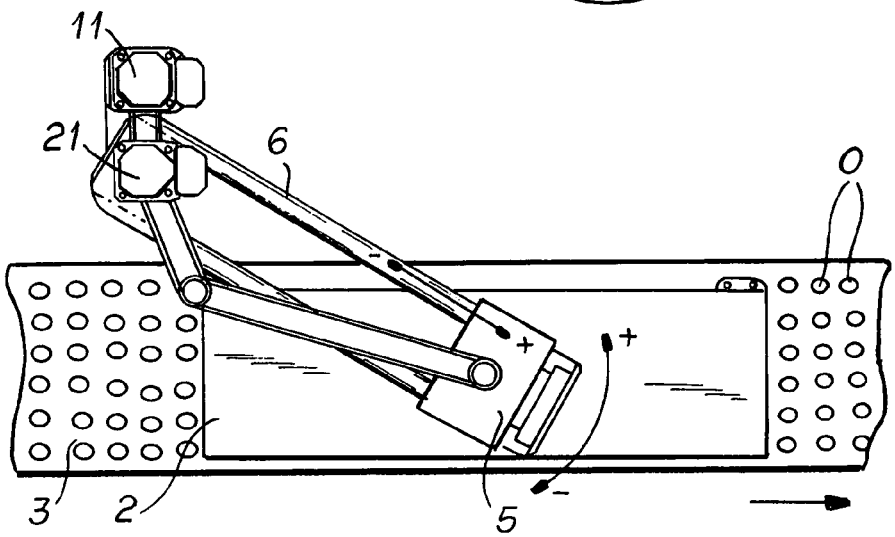
FIG. 8 is another view like FIG. 6 at the end of deposition of the objects.
Figure 9:
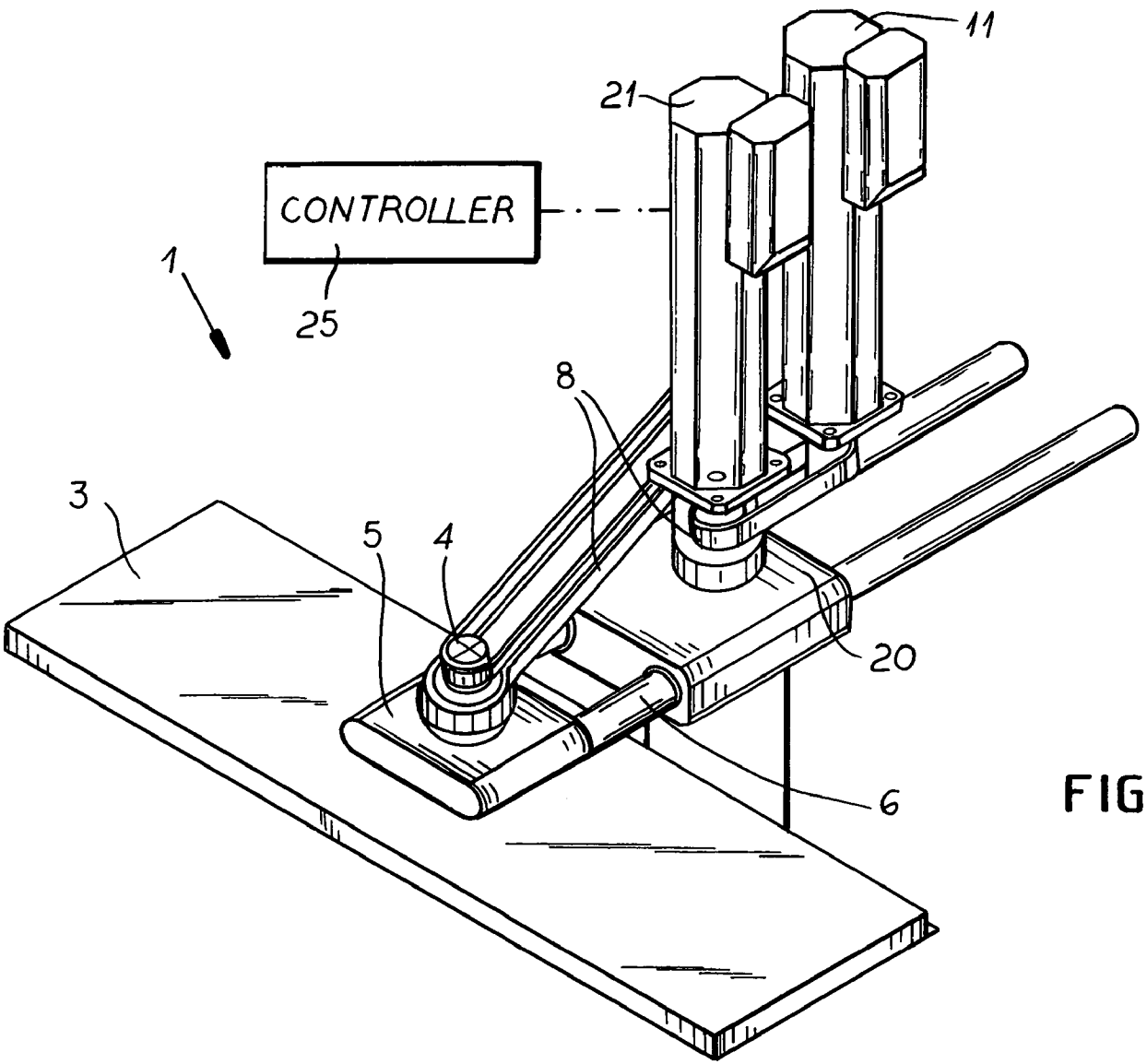
FIG. 9 is a view like FIG. 1 of a second embodiment of the apparatus according to the invention.
Figure 10:
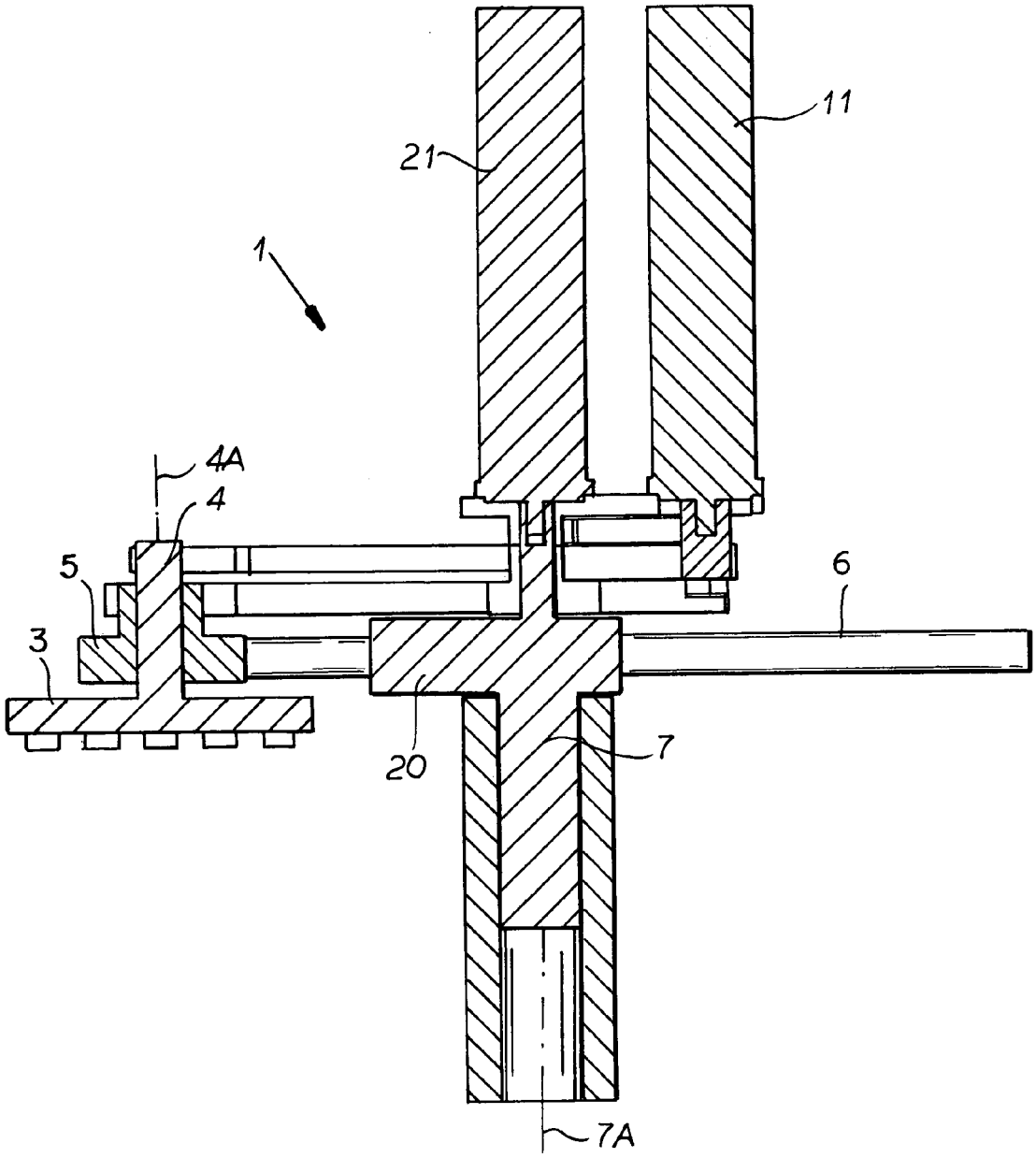
FIG. 10 is the vertical section through the second apparatus.
Figure 11:
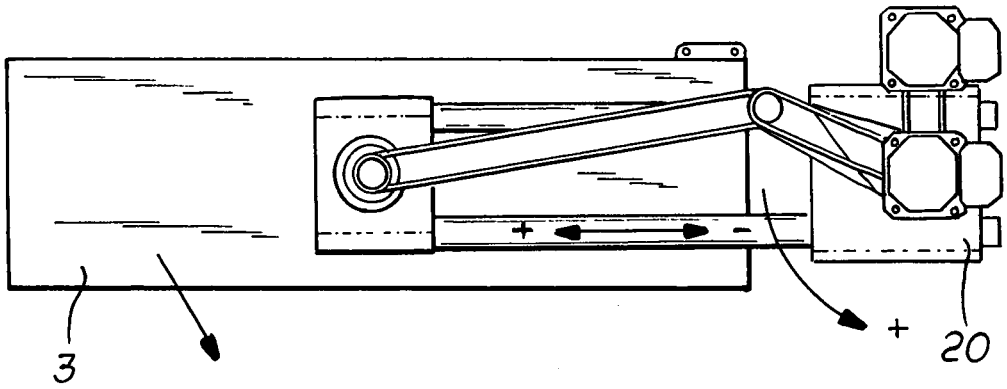
FIGS. 11 through 14 are top views of the second apparatus in succeeding stages of pickup and deposition of the objects on the packaging foil.
Figure 12:
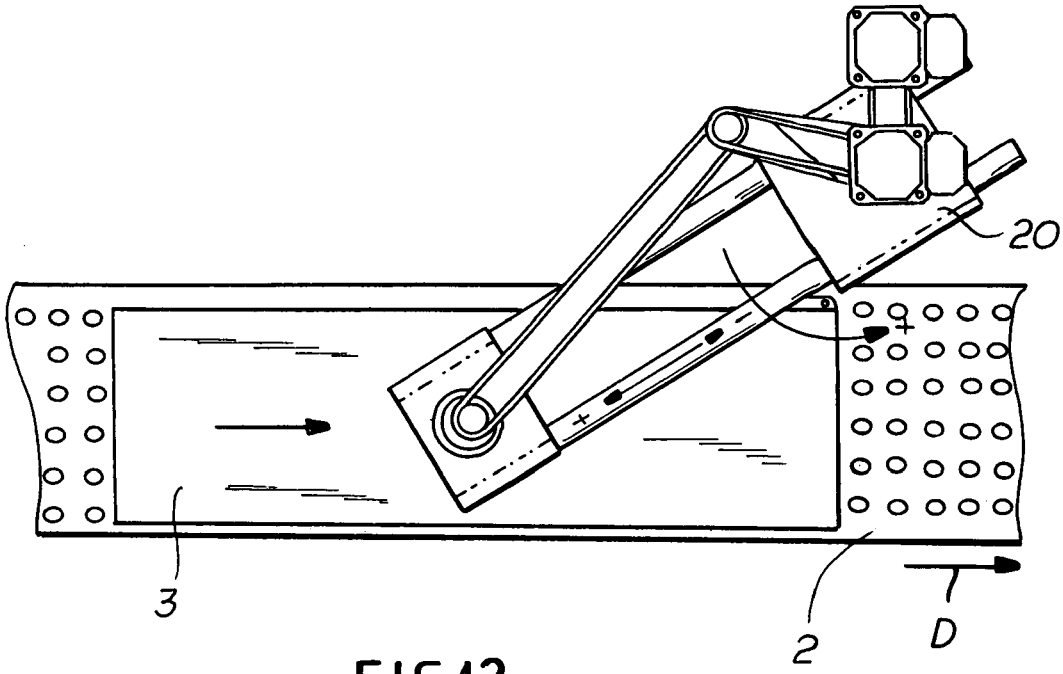
Figure 13:
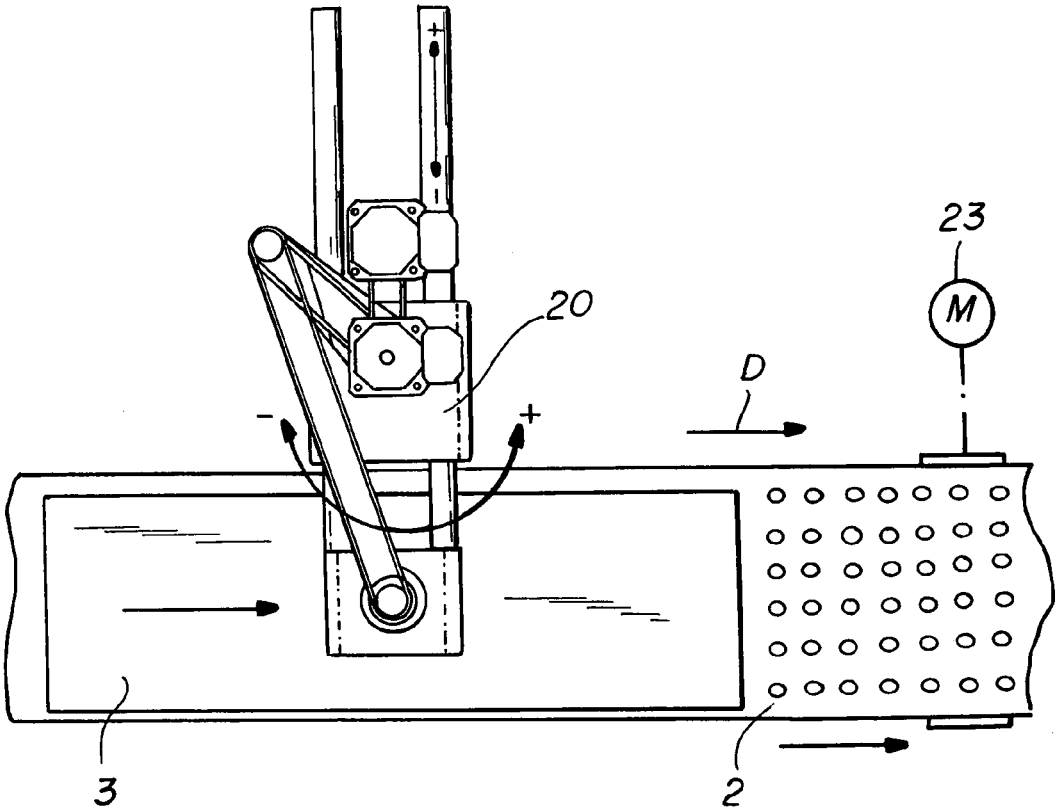
Figure 14:
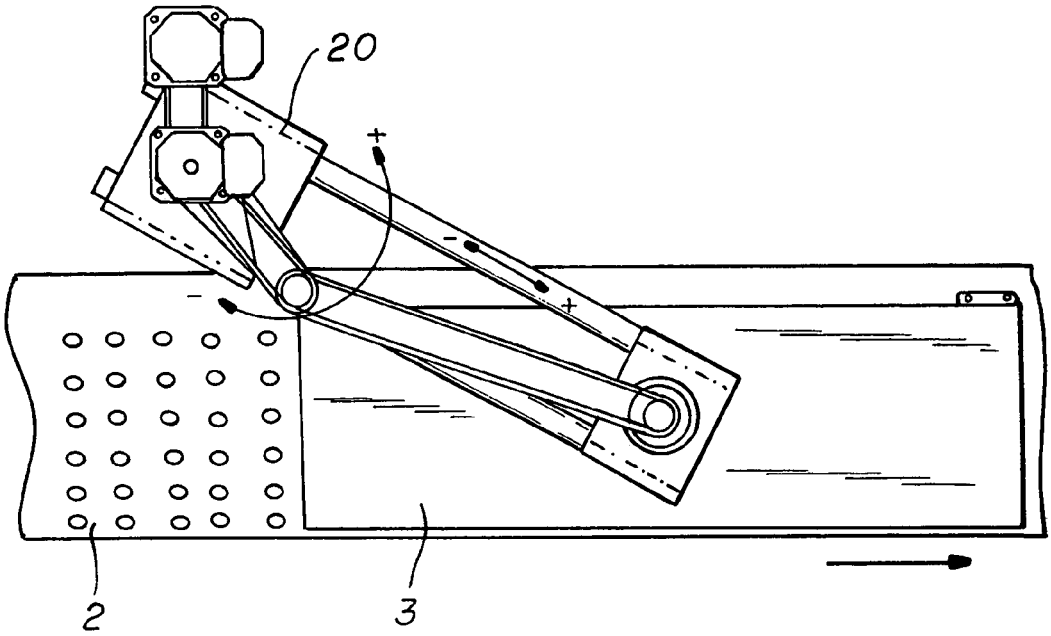

The following explains in greater detail a transfer cycle using the example of the first illustrated embodiment in FIGS. 6 through 8.

In accordance with FIG. 6, the suction plate 3 is in the pick-up position for the sorted objects over a pickup station 26. The slide 5 on the pivot arm 6 is extended to its maximum extent and is near the free end of the pivot arm 6. The knee levers 9 and 10 form a wide obtuse angle. The longitudinal axis of the suction plate 3 is parallel to the longitudinal axis of the pivot arm 6 and also to the transport direction D. After the objects O have been picked up by the suction plate 3, the pivot arm 6 is displaced by the drive 21 about the support axis 7A in the counterclockwise direction as seen from above, here indicated by a plus sign. The drive 11 meanwhile does nothing.

Counterclockwise pivoting of the pivot arm 6 about the support axis 7 causes the angle between the knee levers 9 and 10 to become smaller and consequently forces the suction plate 3 pivoted clockwise (the direction shown by the minus sign) that is to move radially toward the support axis 7A. At the same time, displacement of the knee levers 9 and 10, mediated via the flexible drive 14, necessarily leads to rotation of the suction plate 3 about the slide axis 4A in the negative direction. For synchronizing the suction plate 3 to the foil strip 2, the drive 21 rotates the pivot arm 6 in the positive direction. The second drive 11 rotates the knee levers 9 and 10, if necessary, via the drive belts 12 also in the positive direction. This causes the suction plate 3 to move radially away from the support axis 7, and at the same time, mediated via the flexible drive 14, in the negative direction rotationally about the slide axis 4. In this way the first drive 21 and the second drive 11 are matched to one another such that the suction plate 3 moves parallel to and above the foil strip 2 and at the same speed and thus there can be reliable deposition of the objects into the blisters of the foil strip 2.

Then the suction plate 3 is again moved to the retrieval position for picking up the sorted objects. The first drive 21 rotates the pivot arm 6 about the support axis 7 in the negative direction. The second drive 11 initially remains motionless. By opening the angle between the knee levers 9 and 10, the suction plate 3 is displaced radially in the positive direction and extends relative to the pivot arm. At the same time, the suction plate 3 is rotated about the slide axis 4A by the flexible drive 14 in the positive direction. For precisely aligning the suction plate 3 over the sorted objects, the second drive can be used for a further rotation of the knee levers 9 and 10 and associated herewith displacement of the suction plate 3 radial to the support axis 7, and for a corresponding rotation of the suction plate 3 about the slide axis 4.

This apparatus permits the pick-up and the deposition of the objects at different positions and permits the suction plate 3 to be moved along different tracks. Moreover, an expansion of the positions the suction plate 3 can reach can be attained using an appropriate simple exchange of the pulleys 18, 19 of the flexible drive 14. This can be used to vary the degree of the rotational displacement of the suction plate 3 about the slide axis 4A depending on the degree of the radial displacement of the suction plate 3 with respect to the support axis 7 in a wide frame.

I claim:

1. An apparatus for transferring a plurality of objects from a pickup station to blisters of an adjacent passing foil, the apparatus comprising:

a stationary support adjacent the foil and pickup station and defining a support axis;

an arm pivotal on the support about the support axis and extending radially from the support axis;

a slide on the arm, shiftable radially of the support axis and defining a slide axis;

a suction grab pivotal on the slide about the slide axis, the suction grab being adapted to pick up and drop a plurality of the objects;

first drive means including a first motor on the support and a linkage between the first motor and the arm for pivoting the arm about the support axis between a pickup position with the grab over the pickup station and a deposit position with the grab over the passing foil;

second drive means including a second motor on the support and a linkage between the second motor and the slide for shifting the slide along the arm; and third drive means including a linkage connected between the support and the grab for pivoting the grab about the slide axis relative to the slide.

2. The object-transferring apparatus defined in claim 1 wherein the third drive means synchronizes angular movement of the grab with angular movement of the arm.

3. The object-transferring apparatus defined in claim 2 wherein the third drive means maintains an axis of the grab extending radially of the slide axis always parallel to a travel direction of the passing foil.

4. The object-transferring apparatus defined in claim 1 wherein the third drive means includes an inner stationary wheel on the support at the support axis, an outer wheel fixed to the grab at the slide axis, and at least one belt having an outer end reeved over the outer wheel and an inner end reeved over the inner wheel.

5. The object-transferring apparatus defined in claim 1 wherein the second drive means includes a knee-lever linkage including an inner knee lever having an inner end journaled at an intermediate axis on the support on the support axis and outer end, and an outer knee lever having an inner end journaled on the outer end of the inner lever and an outer end journaled on the slide at the slide axis.

6. The object-transferring apparatus defined in claim wherein the third drive means includes an inner stationary wheel on the support at the support axis, an outer wheel fixed to the grab at the slide axis, an intermediate wheel journaled at the intermediate axis on the levers, an inner annular drive element having an inner end reeved over the inner wheel and an outer end reeved over the intermediate wheel, and an outer annular drive element having an inner end reeved over the intermediate wheel and an outer end reeved over the outer wheel.

7. The object-transferring apparatus defined in claim 6 wherein the drive elements are belts.

8. The object-transferring apparatus defined in claim 1, further comprising means for displacing the foil continuously in a horizontal transport direction past the pickup station, the support axis being vertical, offset from the foil, and parallel to the slide axis.

9. The object-transferring apparatus defined in claim 1 wherein the arm has a pair of parallel rods on which the slide can shift.

10. The object-transferring apparatus defined in claim 1, further comprising a mount pivotal about the support axis on the support, the slide and the arm being fixed together and shiftable radially of the support axis in the mount.

11. The object-transferring apparatus defined in claim 1 further comprising control means connected to both of the motors to move the grab between a pickup position in the pickup station and a deposition position over the film and traveling at a speed identical to a travel speed of the passing foil.

* * * * *